United States Patent [19]

Roy

[11] Patent Number: 4,712,310

[45] Date of Patent: Dec. 15, 1987

[54] CO-SPRAY TECHNIQUE

[75] Inventor: Suva B. Roy, Bear, Del.

[73] Assignee: E. I. Du Pont de Nemours and Company, Wilmington, Del.

[21] Appl. No.: 907,218

[22] Filed: Sep. 15, 1986

[51] Int. Cl.[4] ..... F26B 5/06

[52] U.S. Cl. ..... 34/5; 34/15; 34/57 R

[58] Field of Search ..... 34/5, 57 R, 15, 92

[56] References Cited

U.S. PATENT DOCUMENTS

| | | | |
|---|---|---|---|
| 3,269,905 | 8/1966 | Damaskus et al. | 167/58 |
| 3,616,543 | 11/1971 | Barclay | 34/5 |
| 3,721,725 | 3/1973 | Briggs et al. | 264/6 |
| 3,862,302 | 1/1975 | Price et al. | 424/12 |
| 3,932,943 | 1/1976 | Briggs et al. | 34/5 |
| 4,178,695 | 12/1979 | Erbeia | 34/5 |
| 4,295,280 | 10/1981 | Krupey | 34/5 |
| 4,351,158 | 9/1982 | Hurwitz et al. | 62/60 |

*Primary Examiner*—Larry I. Schwartz

[57] ABSTRACT

A co-spray method for preparing homogeneous hybrid powders suitable for preparing tablets is provided. The tablets are useful as reagent carriers for diagnostic assays.

4 Claims, No Drawings

CO-SPRAY TECHNIQUE

FIELD OF INVENTION

This invention relates to a method for producing tablets which contain ingredients which are incompatible if combined in a single solution.

BACKGROUND ART

For convenient and efficient testing of clinical samples of biological fluids, small precise quantities of stable diagnostic reagents are needed. These reagents must be efficiently and economically prepared in large quantities without sacrificing precise delivery of the reagents. Further, the reagents should be delivered to the user in a stabilized form so as to prevent wastage of expensive reagents. The form in which the reagents are provided must be suitable for use in simple and rapid testing without the intervention of highly skilled technicians. One form which can meet these needs is a tablet containing all the reagents necessary to conduct a given diagnostic assay.

A tablet of this type needs to be stable, easily prepared in a highly reproducible manner, and to dissolve rapidly upon mixing with an appropriate sample. There must be good tablet-to-tablet reproducibility, which in turn means that the dry powder blend from which the tablets are made must be homogeneous. The reagents must withstand the conditions used to prepare the powder blend and then the tablets, and the resulting tablet must be easily dissolved in aqueous solutions.

Preferred tablets for use in diagnostic applications are very small, preferably less than 50 mg and more preferably less than 10 mg. The need for such small tablets compounds the normally difficult problems of producing tablets useful as carriers of diagnostic reagents. The problem of inhomogeneity of the dry powder blend used to form the small tablets is particularly severe as even minor inhomogeneities will have large adverse effect on the tablet-to-tablet reproducibility. This is so because of the relatively small number of dry powder particles used to form each tablet. In order to obtain the necessary homogeneity, techniques such as the S-1 spray freeze process are required (see, for example, U.S. Pat. No. 3,932,943, issued Jan. 20, 1976, and U.S. Pat. No. 3,721,725, issued Mar. 20, 1973, both to Briggs et al.).

Use of tablets prepared by the S-1 spray freeze process, which contain all the ingredients necessary to perform a diagnostic assay, are limited to those diagnostic assays in which all the ingredients are compatible in a single aqueous solution. That means, for example, that an assay requiring both an enzyme and its substrate cannot be provided as a single tablet formed from a blend made by the S-1 process. This is so because when the solution to be sprayed is prepared, the enzyme and substrate react consuming the substrate making it unavailable in the final tablet.

Various methods have been employed in the past to obtain a dry product containing at least two materials which are incompatible with each other in aqueous solution. None of these methods produces materials which are suitable for compressing into the small tablets needed as carriers of diagnostic reagents because these methods ultimately required bulk lyophilization of a frozen mass and it is known that bulk lyophilization produces powders with significant inhomogeneities. Exemplary processes are those disclosed by Damaskus, U.S. Pat. No. 3,269,905, issued Aug. 30, 1966; Barclay, U.S. Pat. No. 3,616,543, issued Nov. 2, 1971; Price et al., U.S. Pat. No. 3,862,302, issued Jan. 21, 1975; Krupey, U.S. Pat. No. 4,295,280, issued Oct. 20, 1981; and Hurwitz et al. U.S. Pat. No. 4,351,158, issued Sept. 28, 1982. Damaskus describes a method of freezing successive layers of incompatible materials in a container followed by bulk lyophilization. Barclay describes a method where solutions of incompatible materials are sequentially charged into a container with freezing of the charge and rotation of the container between charges so that the separate charges do not touch, again followed by bulk lyophilization. Price et al. describe a method in which solutions of incompatible materials are separately formed into frozen beads, the frozen beads are lyophilized separately. The only method disclosed for mixing the dried beads is counting of the number of beads added to a vial. There is no method shown for combining the beads prior to lyophilization nor is there any disclosure aimed at insuring complete mixing of the two populations of beads so that concentration gradients are not formed in the resulting powder. Krupey describes a method in which the solutions of the incompatible materials are first cooled, then mixed together and immediately charged into a container which had been cooled substantially below the freezing temperature of the solutions. The frozen charge is then subjected to bulk lyophilization. This method is further limited in that the amount of material processed is limited by the volume which can be charged into the freezing container rapidly. If large volumes are to be processed, the time required to charge the container will be too long allowing the incompatible materials to react with each other. Hurwitz et al. describe a method of charging two solutions of incompatible materials into separate portions of a container where they are immediately frozen so as not to come into contact with each other. These charges are then bulk lyophilized. None of the methods disclosed offers a satisfactory solution to the problem of preparing homogeneous dry powders suitable for forming into compressed tablets useful as carriers of diagnostic reagents.

Thus, there is a need for an improved spray-freeze process which allows production of tablets containing incompatible ingredients.

DISCLOSURE OF THE INVENTION

A process for preparing a free flowing dry powder blend suitable for preparing tablets containing ingredients which are incompatible in a single aqueous solution comprising the steps of:

(A) preparing at least two solutions suitable for use in S-1 spray-freeze processes, wherein each solution comprises ingredients compatible with one another, and wherein at least one ingredient is incompatible with at least one ingredient of another solution;

(B) spraying said solutions through separate spray nozzles onto the surface of a moving bath of boiling fluorocarbon refrigerant having a temperature below about −20° C. in such a way as to form hybrid droplets and immediately freezing said hybrid droplets;

(C) collecting the hybrid droplets; and (D) lyophilizing said droplets.

A process for preparing a tablet containing ingredients which are incompatible in a single aqueous solution comprising the steps of:

(A) preparing at least two solutions suitable for use in S-1 spray-freeze processes, wherein each solution comprises ingredients compatible with one another, and wherein at least one ingredient is incompatible with at least one ingredient of another solution;

(B) spraying said solutions through separate spray nozzles onto the surface of a moving bath of boiling fluorocarbon refrigerant having a temperature below about −20° C. in such a way as to form hybrid droplets containing the components of the solutions and immediately freezing said hybrid droplets;

(C) collecting the hybrid droplets;

(D) lyophilizing said droplets; and (E) forming tablets from the dry powder blend resulting from said lyophilization.

By S-1 spray-freeze processes is meant the processes disclosed by Briggs et al., U.S. Pat. No. 3,932,943, issued Jan. 20, 1976, and U.S. Pat. No. 3,721,725, issued Mar. 20, 1973, both incorporated herein by reference.

DESCRIPTION OF THE INVENTION

The components of a diagnostic assay can be incompatible with one another in a variety of ways. The incompatible components can be an enzyme and its substrate; an antibody and its complementary ligand; they can be compounds reactive with each other; they can be a pH sensitive component and a buffer of such a pH; or many other combinations. This incompatibility can be due to immediate reaction of some components with each other or the result of a destabilizing effect of the combination of the respective components. It is expected that the skilled artisan will quickly recognize other aspects of incompatibility. For whatever reason the components are found to be incompatible, the problem remains of how to provide the components of a diagnostic assay to the user in a form that allows simple, rapid, efficient precise and accurate determination of the analyte in question.

Surprisingly, it has been found that free flowing powder blends (hybrid powder) and tablets can be prepared which contain components which, if provided as a single solution, would be incompatible. The tablets prepared by the co-spray method of this invention are homogeneous, precise, stable, active, non-crumbling, conveniently dispensed, and easily and quickly dissolved.

To carry out this method, two solutions, or more if one needs to deal with several mutually incompatible reagents which do not permit bringing together all of the reagents in only two separate solutions, containing all components of a diagnostic assay are prepared. For convenience, the co-spray method will be described in terms of two solutions which can be referred to as Solution A and Solution B. Each solution must individually contain only those components which are themselves compatible. The incompatible components are therefore segregated into separate solutions. There can be more than one pair of incompatible components in these solutions provided that all incompatible components can be segregated into the two solutions. Each solution must meet all requirements for being useful in an S-1 spray-freeze process. In general, this means the solutions must contain an excipient which provides sufficient bulk density when lyophilized to form a tabletable powder along with the desired active components. Other additives can also be included to provide other desirable properties. Such additives can be stabilizers, lubricants, electrolytes, excipients or others. The total solids content of such solutions is preferably 30–35% (w/v).

As described in applicants' assignee's copending application Ser. No. 868,668, filed May 30, 1986 now Pat. No. 4,678,812, trehalose is a preferred excipient for use in S-1 spray-freeze processes. It has been found that trehalose functions as a superior excipient and stabilizer in S-1 processes. It is soluble in water up to 50% (w/v) at room temperature, lyophilizes without melt back or formation of syrups or amorphous masses and not only is compatible with a variety of diagnostic reagents but also enhances the stability of many of these reagents. Tablets containing trehalose have also been found to dissolve readily in aqueous solutions and show excellent tablet-to-tablet reproducibility. Other sugar excipients such as mannitol, maltose, lactose and inositol can also be used.

The two solutions are sprayed from separate nozzles onto the surface of a flowing bed of boiling fluorocarbon liquid in a manner such that the droplets of the two streams converge and coalesce as they strike the surface of said fluorocarbon bed. This convergence and coalescence assures the formation of hybrid droplets which contain the components of both solutions. By forming such hybrid droplets on the surface of the fluorocarbon bed, they are immediately frozen preventing interaction of the incompatible ingredients.

Proper alignment of the spray nozzles is very important to achieving the formation of hybrid droplets which then immediately freeze. This alignment is most easily accomplished by spraying trial solutions and visually observing the streams. The nozzles can then be adjusted so that the two streams of droplets converge at or very near the point at which they meet the surface of the flowing bed of fluorocarbon. As a practical manner, this adjustment can be made in any manner, but it is frequently convenient to fix one nozzle and adjust the second. These adjustments can be as simple as bending the nozzle to achieve the desired alignment. Also, as a practical matter, the alignment can vary slightly so long as hybrid droplets are formed and the droplets freeze prior to complete mixing of the components of the separate solutions. There are several factors to be considered and manipulated to insure proper hybrid droplet formation: viscosity and relative solids content of the solutions, the force with which the solutions are sprayed, the temperature of solutions, starting volumes, and nozzle gauges, among others.

Proper alignment of the streams and formation of hybrid droplets can be confirmed by spraying colored solutions and examining the resulting droplets. Using a yellow Solution A and blue Solution B according to the method of this invention, hybrid droplets were formed in which about one half of the droplet was yellow and the other half blue. Green droplets were not formed.

The frozen hybrid droplets are collected and lyophilized according to standard procedures to produce a free flowing dry powder blend. The dry blend contains individual dry glomules which are the result of lyophilization of the individual frozen droplets. These dry glomules individually contain all of the components of both solutions and thus provide a homogeneous mixture of those components for preparation into tablets. This free flowing powder is referred to as a hybrid powder and represents another aspect of this invention. The hybrid powders of this invention offer many advantages over conventional powders, containing incompatible ingredients as defined herein in the preparation of small tablets for carrying reagents for diagnostic assays. Perhaps the major advantage is that these hybrid powders are substantially homogeneous even in their smallest amounts. The component glomules of conventional powders tend to segregate into areas containing greater or lesser amounts of one type of glomule. Such segregation tends to occur based upon size or density of the component glomules.

The hybrid powder can be screened, for example, through a 30-mesh screen using an oscillating granulator, although this is not required, and tabletted using any appropriate tablet press. The choice of an appropriate tablet press is generally dependent more upon the quantity and size of the tablets desired than the method used to produce the dried powder blend from which the tablets are made.

Among many other uses, the tablets of this invention can be utilized in diagnostic assays as reagent carriers. For example, tablets were prepared for use in a diagnostic assay for theophylline based upon inhibition of the enzyme alkaline phosphatase [Vinet et al., Clinical Chemistry, Volume 25(8), 1370–1372 (1979)]. A representative formulation for a single tablet theophylline diagnostic assay using the method of this invention is as follows:

| SOLUTION A | |
|---|---|
| Component | Amount/Tablet |
| Tris(hydroxymethyl)aminomethane, hydrochloride | 0.55 mg |
| Triton X-100 | 0.10 mg |
| Trehalose | 5.75 mg |
| Polyethylene glycol 6000 | 0.40 mg |
| Magnesium acetate | 0.03 mg |
| Alkaline phosphatase (bovine kidney) | 0.87 μg |

| SOLUTION B | |
|---|---|
| Component | Amount/Tablet |
| Tris(hydroxymethyl)aminomethane, hydrochloride | 0.55 mg |
| Triton X-100 | 0.10 mg |
| Trehalose | 5.75 mg |
| Polyethylene glycol 6000 | 0.40 mg |
| Magnesium acetate | 0.03 mg |
| Para-nitrophenyl phosphate, di-sodium salt | 0.16 μg |

Tablets produced using this formulation and the method of this invention are useful for assaying theophylline in the concentration range 2–40 μg/mL. No assay would be possible if the enzyme, alkaline phosphatase, and the substrate, para-nitrophenyl phosphate, were brought together in solution for tablet preparation according to the prior art: the substrate would be consumed prior to carrying out the assay.

Another representative formulation, a single tablet for alkaline phosphatase diagnostic assay, is as follows:

| SOLUTION A | |
|---|---|
| Component | Amount/Tablet (mg) |
| 3-(cyclohexylamino)propane sulfonic acid (CAPS) | 1.29 |
| Magnesium acetate | 0.39 |
| Triton X-100 | 0.05 |
| Trehalose | 1.88 |

-continued

| SOLUTION A | |
|---|---|
| Component | Amount/Tablet (mg) |
| Carbowax 6000 | 0.25 |
| Solution pH | 10.45 |

| SOLUTION B | |
|---|---|
| Component | Amount/Tablet (mg) |
| Trehalose | 3.04 |
| Carbowax 6000 | 0.25 |
| Triton X-100 | 0.06 |
| Di[tris(hydroxymethyl)methyl ammonium] para-nitrophenyl phosphate | 0.16 |
| Solution pH | 9.5 |

The substrate para-nitrophenyl phosphate salt provided in a tablet prepared from solutions A and B shows superior storage stability when compared to a conventionally prepared tablet from a single solution. The substrate is less stable at pH=10.45, the preferred pH value for the sample (enzyme)-substrate reaction, and, also, the interaction of this substrate with the CAPS buffer and magnesium acetate causes significant instability. Thus, separating the substrate from these components leads to improved stability. When incorporated into a conventional single tablet, the substrate was substantially completely degraded after storage at 35° C. for 28 days. Greater than 90% of the substrate remained available in the tablets produced by the method of this invention under those storage conditions.

Yet another representative formulation for a single tablet diagnostic assay of phenytoin based upon the EMIT technology is shown below.

| SOLUTION A | |
|---|---|
| Component | Amount/Tablet |
| Tris(hydroxymethyl)aminomethane | 0.16 mg |
| Tris(hydroxymethyl)aminomethane hydrochloride | 0.43 mg |
| Sodium chloride | 0.35 mg |
| Carbowax 6000 | 0.42 mg |
| Nicotinamide adenine dinucleotide (NAD) | 0.13 mg |
| Glucose-6-phosphate disodium salt | 0.05 mg |
| Anti-phenytoin antibody concentrate | 0.29 mL |
| Trehalose | 2.61 mg |

| SOLUTION B | |
|---|---|
| Component | Amount/Tablet |
| Tris(hydroxymethyl)aminomethane | 0.16 mg |
| Tris(hydroxymethyl)aminomethane hydrochloride | 0.43 mg |
| Sodium chloride | 0.35 mg |
| Carbowax 6000 | 0.42 mg |
| Phenytoin-glucose-6-phosphate dehydrogenase conjugate concentrate | 0.29 mL |
| Trehalose | 2.81 mg |

The NAD and glucose-6-phosphate salt of Solution A are the substrates for the glucose-6-phosphate dehydrogenase enzyme conjugate of Solution B. If these ingredients were present in a single aqueous solution, the enzyme would rapidly react with the substrates consuming them. The resulting mixture would not be useful in the determination of phenytoin.

Tablets of this invention can be useful for assaying a wide variety of other substances such as hormones, enzymes, electrolytes, metabolites, therapeutic drugs and others. For example, formulations have been developed which allowed production of tablets useful for assaying phenobarbital and uric acid requiring only a single tablet per assay.

Also the dry powder blends, the hybrid powders, of this invention can be used to advantage in many applications. The choice of using dry powders or tablets is generally a matter of convenience.

EXAMPLE 1

THEOPHYLLINE ASSAY

A. Preparation of Tablets

To 150 mL of purified water, the following ingredients were added and dissolved in sequence using a magnetic stirrer:

| | |
|---|---|
| Tris(hydroxymethyl)aminomethane | 5.50 g |
| Triton X-100 | 1.00 g |
| Trehalose dihydrate | 57.50 g |
| Polyethylene glycol 8000 | 4.00 g |
| Magnesium acetate | 0.30 g |

The volume of the solution was brought up to 220 mL with purified water. The solution was divided into two 110 mL portions and one portion was labelled A and the other B. To Solution A, 870 μg of alkaline phosphatase was added and dissolved. To Solution B, 1.60 g of para-nitrophenyl phosphate di-sodium salt was added and dissolved. Both solution A and B were then brought up to 125 mL with purified water. Solutions A and B were then pumped through two 28-gauge hypodermic needles onto the surface of a moving bath of boiling FREON®12 fluorocarbon refrigerant. The streams were adjusted by sight so that they converged at the point they contacted the surface of the fluorocarbon. The hybrid frozen particles were then lyophilized to dryness (moisture content <0.6%). The lyophilized powder was screened through a U.S. standard 30-mesh screen using an Erweka granulator. The resultant free-flowing powder was then compressed into 3/32 inch diameter tablets weighing approximately 7.0 mg on a Stokes 300-511-006 single station tablet press.

B. Evaluation of Tablets

Tablets prepared above were inserted into rotors designed to be utilized with the Analyst TM physician's office profiler (E. I. du Pont de Nemours & Co., Inc., Wilmington, DE). Human serum samples containing known concentrations of theophylline were diluted 1:6 with water and used as samples in different rotors for the Analyst TM profiler in an enzyme-inhibition assay. The increase in absorbance at 405 nm was monitored and found to be linear over a 5-minute interval for each sample. The rates determined for the various samples (eight replicates for each) are reported in Table 1 and indicate that the tablets prepared according to this invention are useful for diagnostic assays.

TABLE 1

| THEOPHYLLINE ASSAY RESULTS | |
|---|---|
| Theophylline (μg/mL) | Rate at 405 nm (mA/min) |
| 0 | 442 |

TABLE 1-continued

| THEOPHYLLINE ASSAY RESULTS | |
|---|---|
| Theophylline (μg/mL) | Rate at 405 nm (mA/min) |
| 2.1 | 432 |
| 4.6 | 404 |
| 8.6 | 394 |
| 21.2 | 364 |
| 39.0 | 356 |

EXAMPLE 2

ALKALINE PHOSPHATASE ASSAY

A. Preparation of Tablets Using Co-Spray Procedure

To 75 mL of purified water, the following ingredients were added and dissolved in sequence using a magnetic stirrer:

| | |
|---|---|
| 3-(cyclohexylamino)propane sulfonic acid | 12.90 g |
| Magnesium acetate | 3.90 g |
| Triton X-100 | 0.50 g |
| Trehalose | 18.80 g |
| Carbowax 6000 | 2.50 g |

The volume was brought up to 110 mL with purified water. The pH of the solution was adjusted to 10.45 with 50% sodium hydroxide solution. The volume of the resulting solution was brought up to 125 mL. The solution was labelled A.

To 75 mL of purified water, the following ingredients were added and dissolved in sequence using a magnetic stirrer.

| | |
|---|---|
| Trehalose | 30.40 g |
| Carbowax 6000 | 2.50 g |
| Triton X-100 | 0.60 g |
| Di[tris(hydroxymethyl)methyl-ammonium] para-nitrophenyl phosphate | 1.60 g |

The volume of the solution was brought up to 110 mL with purified water. The pH of the solution was adjusted to 9.50 with 50% sodium hydroxide solution. The volume of the resulting solution was brought up to 125 mL. The solution was labelled B. Solutions A and B were then pumped through two 28-gauge hypodermic needles onto the surface of a moving bath of boiling FREON®12 fluorocarbon (a registered trademark of E. I. du Pont de Nemours and Company). The streams were adjusted by sight so that they converged at the point they contacted the fluorocarbon. The hybrid frozen particles were then lyophilized to dryness (moisture content <0.6%) The lyophilized powder was screened through a U.S. standard 30-mesh screen using an Erweka granulator. The resultant free flowing powder was then compressed into 3/32-inch diameter tablets weighing approximately 7.0 mg on a Stokes BB-2 rotary tablet press.

B. Preparation of Tablets Using Single Spray Procedure

To 150 mL of purified water, the following ingredients were added and dissolved in sequence using a magnetic stirrer.

| | |
|---|---|
| 3-(cyclohexylamino)propane | 12.9 g |

-continued

| | |
|---|---|
| sulfonic acid | |
| Magnesium acetate | 3.9 g |
| Triton X-100 | 0.5 g |
| Trehalose | 49.2 g |
| Carbowax 6000 | 5.0 g |
| Di[tris(hydroxymethyl)methyl-ammonium] para-nitrophenyl phosphate | 1.6 g |

The volume was brought up to 220 mL with purified water. The pH of the solution was adjusted to 10.45 with 50% sodium hydroxide solution. The volume of the resulting solution was brought up to 250 mL. The solution was then pumped through a 28-gauge hypodermic needle onto the surface of a moving bath of boiling Freon®12 fluorocarbon. The frozen particles were lyophilized to dryness (moisture content <0.6%). The lyophilized powder was screened through a U.S. standard 30-mesh screen using an Erweka granulator. The resultant free-flowing powder was then compressed into 3/32-inch diameter tablets weighing approximately 7.0 mg on a Stokes single station tablet press.

C. Evaluation of Tablets

Tablets prepared in A and B above were inserted into rotors designed for use with the Analyst TM profiler. The stability of the tablets over time was evaluated by determining the reaction rate with a sample containing a known amount of alkaline phosphatase over time. The tablets were stored at 35° C. to accelerate the degradation process. The reaction rate was determined by monitoring the increase in absorbance at 405 nm over a 5-minute interval using the Analyst TM profiler. Absorbance readings were taken every 9 seconds and linear regression analysis was used to determine the rate. The sample was diluted 1:10 with water prior to introducing it into the rotors. Table 2 shows the rates (four replicates) obtained with the Dual Spray tablets of this invention and with Single Spray tablets.

TABLE 2

ALKALINE PHOSPHATASE TABLET STABILITY

| Day | Dual Spray (rate, mA/min) | Single Spray (rate, mA/min) |
|---|---|---|
| 0 | 480 | 480 |
| 1 | 479 | 466 |
| 2 | 480 | 452 |
| 4 | 471 | 450 |
| 7 | 468 | 429 |
| 14 | 464 | 325 |
| 21 | 460 | 107 |
| 28 | 455 | 7 |

The degradation of the substrate in the tablets was monitored directly by determining the initial absorbance at 405 nm when water was used as a sample in the rotors. Higher absorbances indicated higher concentrations of para-nitrophenol, the degradation product of the substrate. The absorbances recorded over time for tablets stored at 35° C. are reported in Table 3 (average of 4 determinations).

TABLE 3

SUBSTRATE DEGRADATION

| Day | Co-Spray (absorbance, mA) | Single Spray (absorbance, mA) |
|---|---|---|
| 0 | 202 | 417 |
| 1 | 197 | 903 |
| 2 | 323 | 1053 |
| 4 | 361 | 1232 |
| 7 | 336 | 1299 |
| 14 | 537 | 1611 |
| 21 | 687 | 1835 |
| 28 | 943 | 3356 |

The results in Tables 2 and 3 show that the Co-Spray tablets of this invention offer vastly superior stability to conventional Single Spray tablets.

I claim:

1. A process for preparing a free flowing dry powder blend suitable for preparing tablets containing ingredients which are incompatible in a single aqueous solution comprising the steps of:

(A) preparing at least two solutions suitable for use in S-1 spray-freeze processes, wherein each solution comprises ingredients compatible with one another, and wherein at least one ingredient is incompatible with at least one ingredient of another solution;

(B) spraying said solutions through separate spray nozzles onto the surface of a moving bath of boiling fluorocarbon refrigerant having a temperature below about −20° C. in such a way as to form hybrid droplets and immediately freezing said hybrid droplets;

(C) collecting the hybrid droplets; and (D) lyophilizing said droplets.

2. The process of claim 1 wherein at least one of the solutions contains trehalose.

3. A process for preparing a tablet containing ingredients which are incompatible in a single aqueous solution comprising the steps of:

(A) preparing at least two solutions suitable for use in S-1 spray-freeze processes, wherein each solution comprises ingredients compatible with one another, and wherein at least one ingredient is incompatible with at least one ingredient of another solution;

(B) spraying said solutions through separate spray nozzles onto the surface of a moving bath of boiling fluorocarbon refrigerant having a temperature below about −20° C. in such a way as to form hybrid droplets containing the components of the solutions and immediately freezing said hybrid droplets;

(C) collecting the hybrid droplets;

(D) lyophilizing said droplets; and (E) forming tablets from the dry powder blend resulting from said lyophilization.

4. The process of claim 3 wherein at least one of the solutions contains trehalose.

* * * * *